United States Patent [19]

Suzuki et al.

[11] Patent Number: 4,520,849

[45] Date of Patent: Jun. 4, 1985

[54] METHOD FOR DISPOSAL OF DEFECTIVE WEFT YARN IN A FLUID JET LOOM

[75] Inventors: Hajime Suzuki, Anjo; Yoshimi Iwano, Ohbu, both of Japan

[73] Assignee: Seisakusho Kabushiki Kaisha Toyoda Jidoshokki, Kariya, Japan

[21] Appl. No.: 447,511

[22] Filed: Dec. 7, 1982

[30] Foreign Application Priority Data

Dec. 11, 1981 [JP] Japan ..... 56-200600

[51] Int. Cl.[3] ..... D03D 49/50

[52] U.S. Cl. ..... 139/116; 139/435; 139/450

[58] Field of Search ..... 139/1 R, 5 E, 116, 429, 139/443, 435, 450

[56] References Cited

U.S. PATENT DOCUMENTS 3,561,498 2/1971 Tiernan ..... 139/116

3,805,850 4/1974 Duynhoven et al. ..... 139/435

4,398,568 8/1983 Rydborn ..... 139/116

FOREIGN PATENT DOCUMENTS 2090294 7/1982 United Kingdom ..... 139/435

*Primary Examiner*—Henry S. Jaudon

*Attorney, Agent, or Firm*—Brooks Haidt Haffner & Delahunty

[57] ABSTRACT

In a fluid jet loom in general, the loom operation is not stopped immediately after detection of the defective weft yarn, resulting unavoidably in the insertion of the next weft yarn. In this regard, the present invention provides a method for disposal of the defective weft yarn in a fluid jet loom which consists in temporarily disabling the weft yarn cutting function of a weft yarn cutter provided to the weft yarn inserting nozzle upon detection of defective weft yarn insertion, and subsequently stopping the loom operation.

5 Claims, 5 Drawing Figures

METHOD FOR DISPOSAL OF DEFECTIVE WEFT YARN IN A FLUID JET LOOM

BACKGROUND OF THE INVENTION

This invention relates to a method for disposal of defective weft yarn in a fluid jet loom.

In general, in a fluid jet loom, the weft yarn is impelled into the warp shed by pressurized fluid such as water or air supplied under pressure from a weft yarn inserting nozzle. In this type of loom, since the weft yarn is impelled only from one side of the loom frame, the weft yarn must be cut at a connecting portion from the selvedge towards the yarn supply each time a measured length of the weft yarn is impelled into the shed.

Referring to FIG. 1, there is shown a conventional loom, wherein the weft yarn W is supplied from a weft yarn supply source 31 to a conventional length measurement unit 33 through a tensioner 32, and the weft yarn W whose length has been measured is supplied by way of an air nozzle 34 for weft yarn pooling, a weft yarn pool pipe 35, weft yarn guide 36 and a gripper 37 to a weft inserting nozzle 3 mounted along with a reed 2 on the upper surface of a sley 1 which is adapted for performing a swinging movement in a known manner. Pressurized fluid is injected along with the weft yarn W in the direction of a guide passage defined by a row of guide members 4 provided at a predetermined pitch at the side of the reed 2 towards the cloth fell. A weft yarn cutter 5 is mounted in the vicinity of the cloth fell on the weft inserting nozzle side for operation in time with loom operation. A cutter blade 7 is provided on the side opposite to the cutter 5 for cutting the waste selvedge 6. A weft yarn sensor 8, which may be of a conventional, photoelectrical type, is provided on the sley 1 on the side opposite to the nozzle 3 for detecting a defective weft insertion. Upon occurrence of a defective weft yarn insertion, it is sensed by the sensor, and the loom operation is discontinued. The defective weft yarn is removed in this state and the loom operation is again started.

In this conventional fluid jet loom, since the loom is operating at a higher r.p.m., it is not possible to stop the loom immediately because of the required braking time even if the occurrence of the defective weft yarn insertion has been sensed by the sensor. It is only possible to stop the loom operation after the defective yarn is beaten up against the previously inserted weft yarn, the weft yarn is cut on the side of the nozzle 3, and the next length of the weft yarn is inserted into the shed. Therefore, disposal of the defective weft yarn may be effected only by extracting the weft yarn which was inserted after the insertion of the defective weft, then, driving the loom frame in forward or reverse direction either by manual operation or actuation of an inching push button, and then opening the upper and lower warp yarns for removal of the defective weft yarn.

However, since the defective weft yarn has been previously cut in the vicinity of the selvedge by the cutter 5 and only a small portion of the yarn is exposed outside of the selvedge and, moreover, the defective weft yarn has undergone the beating to form a part of the cloth, it is extremely difficult to detach it from the cloth. Thus, the conventional practice is to pull out several points of the defective weft yarn into the warp shed using a taper needle, and to pull the weft yarn out of the row of warp yarns by a labor-consuming and painstaking operation.

Therefore, demand has arisen for a method for disposal of defective weft yarn in a fluid jet loom which is free from the above inconveniences of the prior art.

SUMMARY OF THE INVENTION

The present invention provides a method for disposal of a defective weft yarn in a fluid jet loom according to which the weft yarn cutting function of the weft yarn cutter provided on the weft inserting nozzle side of the loom is disabled temporarily and instantaneously upon detection of the defective weft yarn, and subsequently the loom operation is discontinued. The present invention thus utilizes the characteristics of the prior-art device, that loom operation is not stopped instantly upon detection of the defective weft yarn and the next length of the weft yarn is unavoidably inserted in the warp shed. Since in accordance with the present invention the weft yarn is not cut upon detection of a defective weft insertion, the defective weft yarn can be removed and disposed of rather easily.

According to one aspect of the present invention, when the defective weft yarn has been detected, the weft yarn cutting function of the weft yarn cutter is disabled temporarily while the next insertion of the uncut weft yarn is inhibited. In this manner, the length of the weft yarn lying downstream of the weft inserting nozzle in the direction of weft insertion may be minimized so that the amount of weft yarn extracted during removal of the defective weft yarn may be reduced for greatly promoting the yarn removal operation.

BRIEF DESCRIPTION OF THE DRAWINGS

The objects and advantages of this invention will become more apparent from reading the following detailed description in conjunction with the accompanying drawings, in which.

DESCRIPTION OF THE PREFERRED EMBODIMENTS

Figure 1:
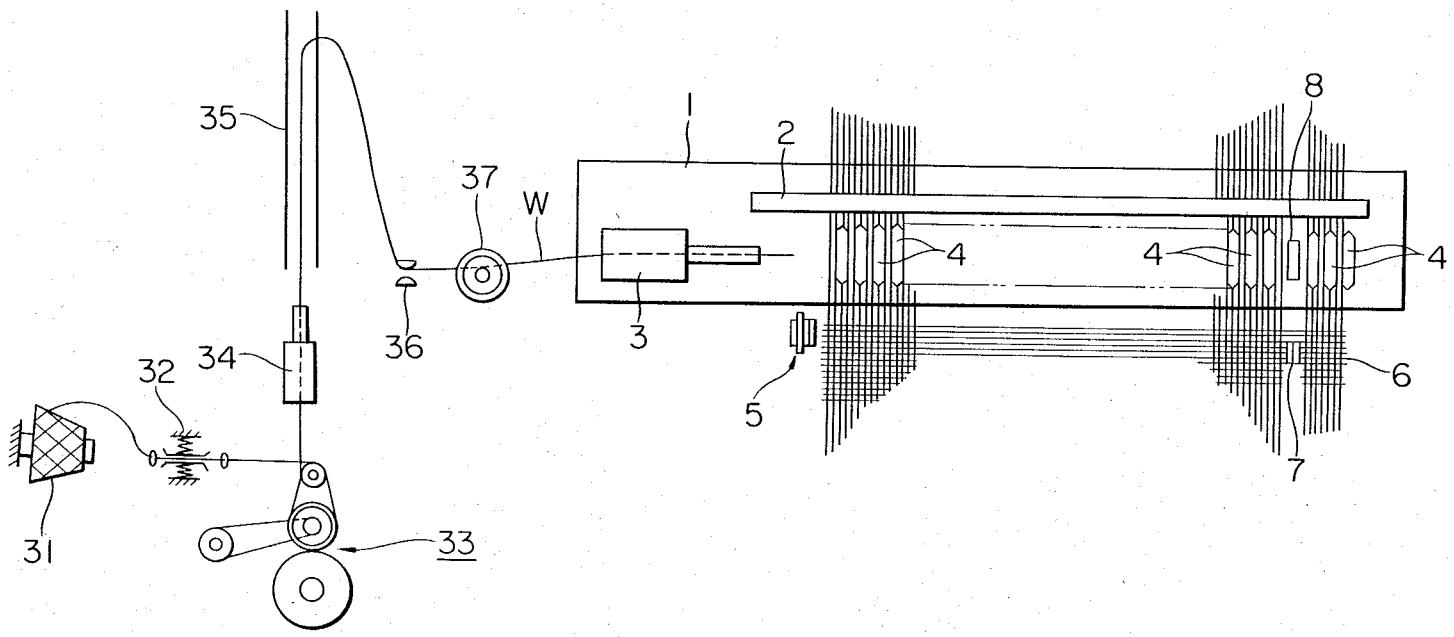
FIG. 1 is a diagrammatic top plan view showing essential portions of a fluid jet loom.

Reference is now had to FIGS. 2 through 5 illustrating a preferred embodiment of the present invention. The fluid jet loom embodying the present invention is different from the conventional device as to the structure of the weft yarn cutter 10 which is substituted for the cutter 5, but is otherwise the same as the aforementioned conventional device. Therefore, the same parts or components are designated by the same reference numerals. A fixed blade 11 placed towards the selvedge is fitted to a fixed support shaft 12 on a machine frame, not shown, and is secured at the rear end to a fixed shaft 11*a* projecting away from the selvedge so as to be unrotatable relative to the machine frame. A movable blade 13 is carried for free rotation by said support shaft 12 and has an arm 13*a* extending obliquely down in the opposite direction to the cutting edge and carrying a drive pin 14. An L-shaped lever 16 is mounted by a shaft 15 for rotation relative to the loom frame and has one end connected through said drive pin 14 to said movable blade 13. The lever 16 is biased by a tension spring 17 for rotation counterclockwise in FIG. 2. A cam follower 20 is mounted for rotation about its own axis towards the distal end of the lever 16 and contacts by a rolling motion with a cam 19 secured to a rotary shaft 18.

Figure 2:
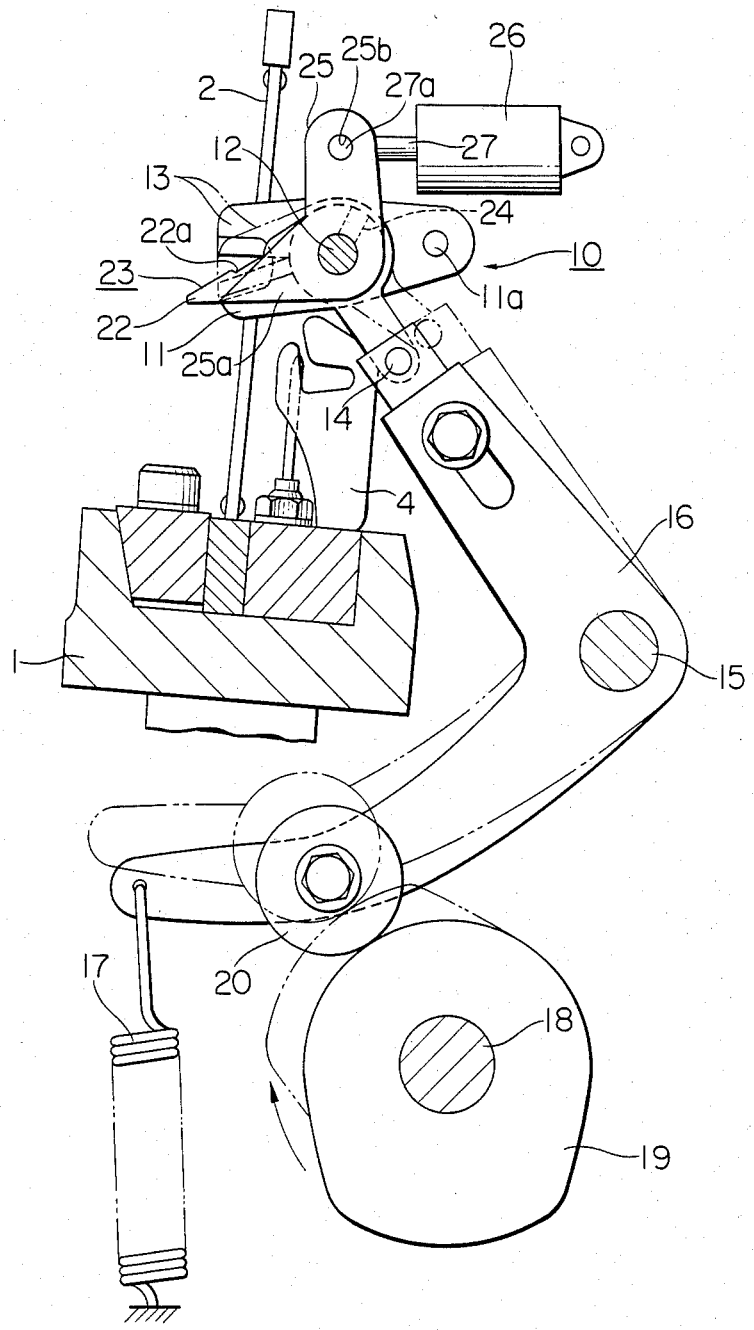
FIG. 2 is a side elevation showing a weft yarn cutter used for practicing the method according to the present invention.
Figure 3:
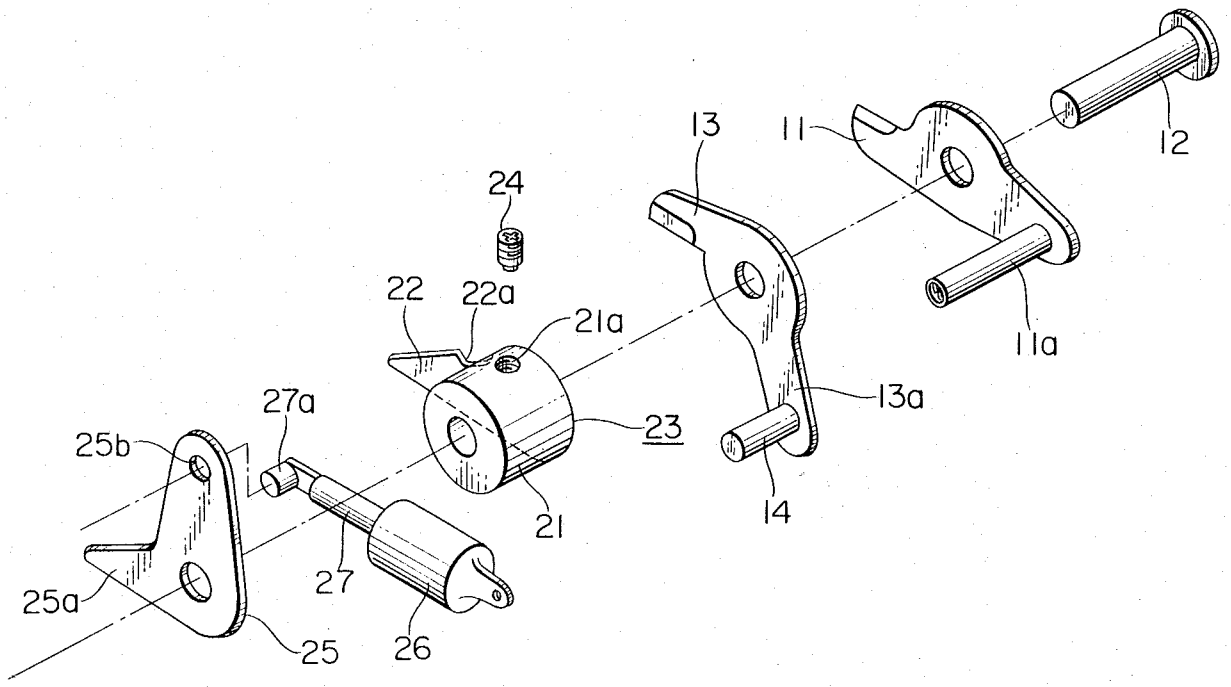
FIG. 3 is an exploded perspective view thereof.
Figure 4:
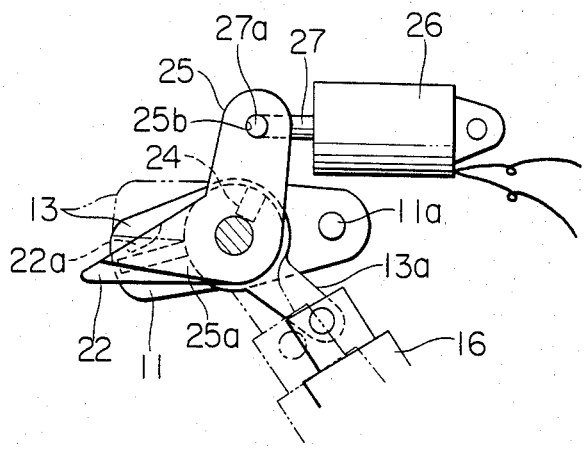
FIG. 4 is a side elevation for explaining the operation of the weft yarn cutter.

A weft yarn guide 23 formed by a cylindrical boss 21 and a triangular guide plate 22 is fitted on the support shaft 12 externally of the rotary blade 13. A guide groove 22*a* is formed on the upper edge of the guide plate 22 while a tapped hole 21*a* is formed in the boss 21. The weft yarn guide 23 is secured to the support shaft 12 by a presser screw 24 threaded to said tapped hole so that the guide groove 22*a* is positioned slightly above the edge end of the fixed blade 11, as seen in FIG. 2. A weft yarn deflector 25 is mounted to the support shaft 12 externally of the weft yarn guide 23 and for rotation about said support shaft. A weft yarn deflecting portion 25*a* is provided to the foremost part of the weft yarn deflector 25 for extending forwardly of the guide groove 22*a* of the guide plate 22. The weft yarn deflector 25 has its upper end formed with an engaging hole 25*b* for engagement by a boss 27*a* at the foremost part of a movable iron core 27 of a solenoid 26 mounted for rotation relative to the loom frame. This solenoid 26 comes into operation when a trouble caused in inserting the weft yarn has been detected by the weft yarn sensor 8 (FIG. 1).

The weft yarn cutter 10 thus far described operates as follows. In the weft yarn cutter 10, the solenoid 26 is normally inoperative and the weft yarn deflector 25 is positioned so that the upper edge of the weft yarn deflective portion 25*a* is at a lower level than the guide groove 22*a* of the guide plate 22 of the weft yarn guide 23. When the loom is driven into operation in this state and the weft yarn is laid down in the open warp shed, the weft yarn end towards the weft yarn inserting nozzle 3 (FIG. 1 ) is introduced into the guide groove 22*a* of the weft yarn guide 23. As the cam 19 is rotated clockwise in FIG. 2 along with the rotary shaft 18 with progress in the loom operation, the lever 16 is kept in the fixed position as long as the lesser diameter portion of the cam 19 contacts the cam follower 29. When the contact portion has passed the lesser diameter portion, the lever 16 is turned clockwise against the force of the tensile spring 17. When the lever 16 has turned from the solid-line position to the double-dotted chain line position in FIG. 2, the rotary blade 13 is also rotated counterclockwise from the solid-line position to the double-dotted chain line position in FIG. 2 for cutting the weft yarn disposed in the guide groove 22*a*. With continued rotation of the cam 19, the lever 16 is turned counterclockwise under the force of the tensile spring 17 and returned to the starting position, the rotary blade 13 being similarly returned to the starting position. Rotation of the cam 19 is synchronized to the swinging movement of the sley 1 so that the rotary blade 13 is rotated in the weft yarn cutting direction as soon as the reed beats up the preceding weft yarn. Thus, in normal loom operation, the weft yarn is cut for each weft inserting operation as soon as the reed beats up the preceding weft yarn.

When a trouble in the weft inserting operation is sensed by the sensor 8 during loom operation, the solenoid 26 is energized via the control circuit 41 and the movable iron core 27 is retracted into the solenoid 26 against the force of a spring (not shown) enclosed in the solenoid 26. The weft yarn deflector 25 is rotated to a position shown in FIG. 4 wherein the upper edge of the deflective portion 25*a* is at the same level as the upper edge of the guide plate 22. In this state, the end of the weft yarn being inserted is not introduced into the guide groove 22*a* of the weft yarn guide 23 when the sley 1 is swung towards the cloth fell, but rides on the upper edge of the deflective portion 25*a*. Thus, when the sley 1 is turned in a direction away from the cloth fell after beating, the weft yarn end slides on the upper edge of the weft yarn deflective portion 25*a* and is not engaged at the cutting point, that is, the guide groove 22*a*, so that the weft yarn is not cut in spite of rotation of the rotary blade 13.

Figure 5:
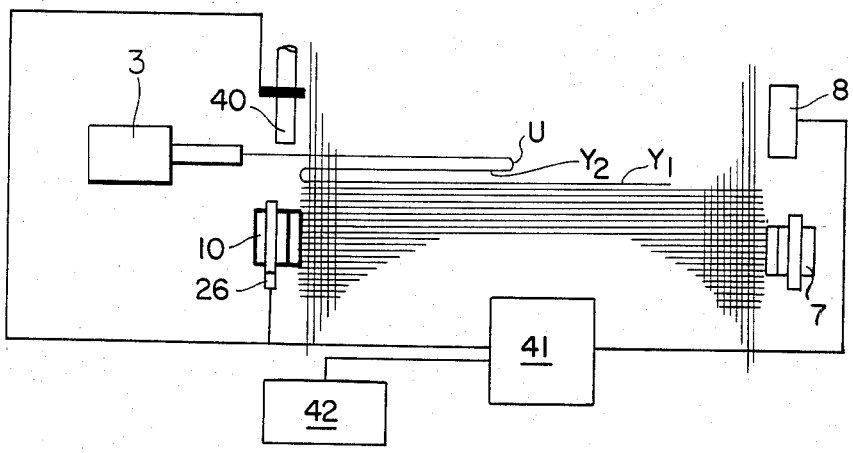
FIG. 5 is a diagrammatic top plan view showing the state of weft yarn insertion following detection of the defective weft yarn.

In this manner, in the fluid jet loom provided with the weft yarn cutter 10, the weft yarn deflector 25 is energized through solenoid 26 via a control circuit 41 immediately after the weft yarn sensor 8 has sensed the trouble in weft yarn insertion during loop operation for disabling the weft yarn cutting function of the weft yarn cutter 10. The weft yarn inserted after beating the defective weft yarn length $Y_1$ and until the loom is halted by operation of the loom stop mechanism 42 takes the form of a letter U with one end $Y_2$ contiguous to the defective weft yarn $Y_1$, as shown in FIG. 5. Hence the defective weft yarn $Y_1$ may be extracted by pulling the weft yarn $Y_2$ layed down in the form of the letter U, while the loom is operated slowly in reverse by manual operation or by actuation of a push button associated with inching. In this manner, the complicated operation of removing the defective weft yarn as required in the conventional practice may be dispensed with. Extraction of the weft yarn may also be effected through suction by using an air suction gun or the conventional vacuum sucker 40.

For disabling the weft yarn cutting function of the weft yarn cutter 10, the weft yarn may be deflected away from the weft yarn guide 23 by direct operation from the solenoid and hence the yarn deflector 25 may be dispensed with. Alternatively, the rotary blade 13 may be designed to rotate in the direction of the support shaft 12 or the rotation of the rotary blade 13 may be disabled when the defect has been sensed in the insertion of the weft yarn.

In the above preferred embodiment, the succeeding uncut weft yarn portion $Y_2$ which is inserted into the shed contiguous to the sensed defective weft yarn $Y_1$ is not gripped, so that the loom operation is stopped, via the loom stop mechanism 42 which is also actuated by the control circuit 41, with the uncut weft yarn $Y_2$ inserted in the shed in the U shape by the weft insertion nozzle, as illustrated in FIG. 5. However, the loom operation may be stopped while inhibiting the insertion of the uncut weft yarn contiguous to the defective weft yarn. In this case, there is no weft yarn supplied in the U-shape from the weft insertion nozzle, so that the amount of the weft yarn to be extracted with the defective weft yarn may be reduced and the operation of extracting the defective weft yarn may be facilitated.

Insertion of the uncut weft yarn may be inhibited by providing a conventional vacuum sucker 40 between the weft insertion nozzle 3 and the shed so that the sucker 40 is energized, via the control circuit 41 as illustrated in FIG. 5, upon detection of trouble in the weft insertion for sucking the weft yarn. Vacuum sucker 40 may also be used to remove the defective yarn length $Y_1$, by drawing in the yarn length $Y_2$ to which the length $Y_1$ is attached. Alternatively, the weft yarn may be gripped by a gripper 37 (FIG. 1) between a length measuring device 33 and the nozzle 3 or the operation of the device 33 may be stopped for inhibiting the operation of weft yarn insertion.

It is seen from the foregoing description of the preferred embodiment that the weft yarn cutting function of the weft yarn cutter adjacent to the weft insertion nozzle may be disabled temporarily upon trouble detection in the weft yarn insertion and subsequently the loom operation may be stopped while the weft yarn portion to be inserted next time is still uncut and contiguous to the defective yarn for promoting convenience in extracting the defective weft yarn, preferably by using the vacuum sucker 40. Thus the complicated manual operation of pulling out several points of the defective weft yarn into the warp shed by using a tapered needle as required in the conventional device may be dispensed with and the defective yarn may be removed by simply pulling the readily accessible uncut weft yarn portion contiguous to the defective yarn.

What we claim is:

1. A method for disposal of a defective weft yarn in a fluid jet loom, wherein the weft yarn whose length has been measured is inserted by a fluid jet from a weft yarn inserting nozzle into successively formed sheds defined by alternating upper and lower warp yarns and the inserted weft yarn is normally cut by a weft yarn cutter, characterized by the steps of temporarily disabling the weft yarn cutting function by deflecting the weft yarn from the weft yarn cutting point in said weft yarn cutter substantially instantaneously upon detection of a defective yarn insertion and while continuing to insert said weft yarn into the succeeding shed, and subsequently stopping the loom operation whereby the uncut weft yarn contiguous to the defective yarn includes a U-shaped portion and extends to said nozzle.

2. The method according to claim 1, wherein said weft yarn is deflected from said cutting point by preventing said weft yarn from entering a guide groove by which said weft yarn is normally positioned for cutting in said weft yarn cutter.

3. The method according to claim 2, wherein said deflecting is by positioning a deflector edge substantially across said groove, and sliding said weft yarn along said deflector edge away from said cutting point.

4. In a fluid jet loom wherein a weft yarn whose length has been measured is inserted by a fluid jet from a weft yarn inserting nozzle into successively formed sheds defined by alternating upper and lower warp yarns and the inserted weft yarn is normally cut by a weft yarn cutter, the improvement comprising sensor means for sensing a defective weft yarn inserted into said shed, and weft yarn deflecting means mounted on said cutter for movement to deflect said weft yarn away from its normal cutting position within said cutter responsive to actuation of said sensor means upon sensing the presence of said defective weft yarn, whereby said weft yarn remains uncut.

5. The improvement according to claim 4, wherein said cutter comprises a fixed blade, a pivotable blade, and a guide plate mounted in fixed position adjacent to said fixed blade and having means defining a weft receiving groove for guiding said weft yarn between said fixed and pivotable blades, and said deflecting means comprises a weft yarn deflector mounted for pivotal movement adjacent to said guide plate and having an edge for preventing weft yarn from entering said guide plate groove responsive to pivotal movement of said deflector, and solenoid means activated by said actuation of said sensor means to so pivot said weft yarn deflector.

* * * * *